US009949555B2

(12) United States Patent
Wu

(10) Patent No.: US 9,949,555 B2
(45) Date of Patent: Apr. 24, 2018

(54) NESTED WATER-RESISTANT PACK

(71) Applicant: Arthur Wu, North Hollywood, CA (US)

(72) Inventor: Arthur Wu, North Hollywood, CA (US)

(73) Assignee: Arthur Wu, Long Beach, CA (US)

( * ) Notice: Subject to any disclaimer, the term of this patent is extended or adjusted under 35 U.S.C. 154(b) by 0 days.

(21) Appl. No.: 15/005,294

(22) Filed: Jan. 25, 2016

(65) Prior Publication Data

US 2017/0208924 A1 Jul. 27, 2017

(51) Int. Cl.

| | |
|---|---|
| ***B65D 85/00*** | (2006.01) |
| ***A45F 3/00*** | (2006.01) |
| ***A45C 11/00*** | (2006.01) |
| ***A45C 13/10*** | (2006.01) |

(52) U.S. Cl.

CPC ..... *A45F 3/005* (2013.01); *A45C 11/00* (2013.01); *A45C 13/103* (2013.01); *A45C 2011/002* (2013.01); *A45C 2011/003* (2013.01); *A45C 2013/1015* (2013.01)

(58) Field of Classification Search

CPC ... A45F 3/005; A45C 13/103; A45C 13/1023; A45C 13/1015; A45C 13/1007; A45C 13/10; A45C 13/1076; A45C 13/12

See application file for complete search history.

(56) References Cited

U.S. PATENT DOCUMENTS

| | | | | |
|---|---|---|---|---|
| 4,648,121 | A | 3/1987 | Lowe | |
| 5,060,835 | A | 10/1991 | Payne | |
| 5,150,824 | A | 9/1992 | Key | |
| 5,645,205 | A | 7/1997 | Kennedy | |
| 5,775,561 | A | 7/1998 | Kennedy | |
| 5,871,132 | A | 2/1999 | Hargreaves | |
| 6,293,445 | B1 | 9/2001 | Miller | |
| 6,435,392 | B1 * | 8/2002 | Kennedy | A45C 11/22 224/277 |
| 6,619,519 | B1 | 9/2003 | Nix et al. | |
| 6,698,636 | B2 | 3/2004 | Angus | |
| 9,511,922 | B1 * | 12/2016 | Breedwell | B65D 81/34 |
| 2007/0215663 | A1 * | 9/2007 | Chongson | A45C 1/04 224/650 |
| 2014/0069063 | A1 * | 3/2014 | Edmonds | A45C 3/00 53/473 |

* cited by examiner

*Primary Examiner* — Steven A. Reynolds
*Assistant Examiner* — Javier A Pagan

(57) ABSTRACT

A pack for carrying personal effects and protecting such effects from damage caused by contact with moisture is provided. First, a flexible and rugged water-resistant outer container having a resealable opening defines a cavity sized to receive a waterproof pouch along with various other items. Next, the waterproof pouch may have an opening to receive various items. A first means and a second means for sealing the waterproof pouch are successively spaced away from the opening of the pouch. Then, once sealed, a portion of the pouch may be successively folded over the first and second means for sealing the pouch to further reduce any risk that moisture enters the pouch through the sealed opening. Finally, means may be provided for securing the folded portion of the pouch in place to provide nested and redundantly sealed compartments.

20 Claims, 4 Drawing Sheets

NESTED WATER-RESISTANT PACK

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material that is subject to copyright protection. This patent document may show and/or describe matter that is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to containers for carrying and transporting personal items, and more particularly, to a pack having waterproof and water-resistant elements to redundantly protect belongings contained therein from risk of damage caused by contact with moisture.

BACKGROUND

Various compact packs, pouches, and bags have been devised and made available to aid hands-free transportation personal items on the body of a wearer. One such type of bag is commonly known as a "fanny pack" or "hip pack" and may be arranged to be comfortably secured with a strap around a user's waist. Many personal items carried in such packs are susceptible to water damage. This may be especially true of mobile electronic devices—such as mobile phones, smartphones, tablet computers, and even digital cameras—that have become ubiquitous. As technology relating to mobile electronic devices develops to enhance functionality in increasingly portable packages, users often opt to carry such devices on their person wherever they go. This can be convenient for many reasons. For instance, users may access their smartphone to make emergency phone calls, to access data networks allowing them to search for and reference maps, review or post to social media networks, and even capture and digitally share photos taken with built-in cameras from wherever they are. Other items commonly carried on a person, such as forms of identification, key fobs, and paper products including cash money, may be damaged upon contact with water as well.

Such convenience may be limited by the particular surroundings a user finds himself in, though. For instance, it may be desirable to bring a smartphone or even a digital camera on an outdoor hike. In the event of inclement weather, though, there is a risk that such device may become wet and damaged. As another example, a user might wish to bring his mobile electronic device near a body of water, such as a pool, lake, river, waterfall, and man-made fountain, among others. Maintaining the mobile device in his pocket or typical carrying bag or backpack may protect the device from some of the risk associated with incidental contact with water, such as humidity or misting. Still, there is a risk that the device may come into damaging contact with the water if it were to fall out of the pocket or typical carrying bag or backpack. If the bag or pocket were to become wet, moreover, the device could additionally become damaged. Even accidental exposure to water, such as spilling a drink on the device or typical bag or backpack, can be a problem especially if wet items, for example, a water bottle, is stored in the same space as the moisture sensitive belongings.

In light of these problems, some protective packs have been proposed. For example, U.S. Pat. No. 6,698,636 to Angus et al. teaches a ventilated and moisture-wicking waist pack that creates evaporative channels to remove moisture absorbed through portions of the pack. This however, does not prevent moisture from entering portions of the pack, it merely enables escape of any collected moisture. As another example, U.S. Pat. No. 5,775,561 to Kennedy discloses a layered, lightweight pouch for containing personal items during water sports. This proposal is deficient, however, because the first disclosed enclosure is not waterproof, so that any items maintained between the enclosure and waterproof inner pouch are at risk for water damage. Additionally, each of these proposed solutions fail to provide adequate sealing members to further prevent moisture from potentially entering the packs there through. That is, spaces remain in the proposed openings through which moisture may enter.

As still another example, U.S. Pat. No. 6,293,445 to Miller discloses a protective pack to be worn at the belt of a wearer which is substantially rigid in construction. The rigid materials provided may protect belongings contained therein from water damage, however, the proposal is deficient because the rigid construction adds potentially inconvenient and discomforting bulk and weight to the pack itself.

Although various proposals have been made to solve the problem, none of those in existence combine the characteristics of the present invention. Therefore, there remains a need for a carrying pack for holding various belongings that maintains mobile electronic devices and other moisture-sensitive items in a dry environment.

SUMMARY

The present disclosure is directed to a nested pack having both waterproof and water-resistant components. Various elements comprising the pack feature redundant seals and water-resistant elements to ensure that any personal effects stored therein, especially personal electronic, devices are kept dry during use. The pack may be worn at the waist of a wearer for convenient hands-free transportation, although other carrying methods are contemplated and possible without deviating from the invention.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In an embodiment, the nested pack comprises an outer container and an inner pouch. More particularly, the outer container may define a cavity accessible through an opening formed on an upward facing portion of the container. The outer container may be sized to receive the inner pouch in addition to various personal effects, such as wallet, keys, identification, medication, etc. and any items contained within the outer pouch, such as a personal electronic device. The opening may be optionally resealed by a wearer by way of a water-resistant zipper known to those skilled in the art.

In some embodiments, the outer container comprises a front side and a back side spaced apart by a side panel. The side panel may comprise a single piece of material or multiple pieces of material. Formed as such, the outer container may take a cuboid shape. In addition, the outer container may comprise a flexible, rugged material capable of withstanding repeated use and exposure to the elements, including water and other liquids. Such materials may be water-resistant so as to ensure that any personal effects contained within the cavity defined by the outer container are protected from liquid that may possibly seep through any pores defined by the material comprising the outer container. For example, durable water repellant coatings may be added to various fabrics available to comprise the outer container to make the outer container hydrophobic. One class of such coatings includes fluoropolymers known to those skilled in the art. One example of a fabric available for such use is polytetrafluoroethylene.

It is contemplated that although water-resistant, the outer shell may comprise a breathable fabric, insuring that any moisture or water vapor which may incidentally become trapped in the outer container may escape therefrom to prevent prolonged exposure to the moisture. It is also contemplated, however, that additional sealants may be applied to portions or all of the outer container to prevent moisture from travelling through it at all.

Next, a pouch disposable within the cavity defined by the outer container may be provided. In an embodiment, the pouch comprises a first layer and a second layer permanently bonded to one another along a respective first edge, second edge, and bottom edge and similarly defines a cavity for receiving personal effects. Respective, unbonded top edges may also define an opening to receive one or more personal effects. More particularly, the pouch may be sized to receive one or more personal electronic devices, such as a smartphone.

The first and second layers may comprise water-impermeable materials which are also resistant to tearing. For example, the first and second layers may comprise multi-laminate polyurethane materials, polyvinyl chloride (PVC), among others known in the art. This may ensure that any particularly moisture-sensitive belongings remain protected against the possibility of water damage, which can be costly to a user.

Means for sealing the pouch may then be disposed along the unbonded top edges of the pouch. Indeed, in some embodiments, multiple means for sealing the pouch are provided to ensure that any openings in the pouch may be redundantly secured against seepage that might occur in the event that the pouch is exposed to any moisture. For instance, in one embodiment, at least one of the means for sealing the pouch may comprise a securely mateable press-to-seal type zippers known in the art. Multiple means for sealing the pouch may be provided as well. For instance, mateable portions of a first press-to-seal zipper and a second press-to-seal zipper may be sequentially placed facing and away from one another in line with the top edges of the first and second layers. A user of the pack may cause such press-to-seal zippers to become securely mated by forcibly pressing such seals together, preventing water from entering the cavity defined by the pouch.

It is contemplated that providing redundant and successive means for sealing the pouch in this manner may ensure that any incidental moisture poised to enter the cavity defined by the pouch on account of an imperfectly secured first seal may be further prevented from contacting any personal items stowed within the cavity by the second seal. One skilled in the art will recognize that the invention may be practiced with only one means for sealing the pouch, or even two or more successive means for sealing the pouch. Additionally, such means are provided as press-to-seal zippers by way of example only and not of limitation.

To even further prevent moisture from reaching any contents within the pouch, it is contemplated that the pouch may be folded over the means for sealing the pouch so that the opening is obscured from direct contact with water. Means for securing the folded portion of the pouch in place may also be provided.

Thus, it is one object of the invention to provide a hands-free carrier for various personal belongings.

It is another object of the invention to provide a carrier or pack that features redundant waterproof and water-resistant features for protecting any belongings contained therein.

It is yet another object of then invention to avoid uncomfortable bulk and weight of typical waterproofing solutions.

It is still another object of the invention to provide nested, sealable compartments to optionally protect particularly moisture-sensitive belongings from the risk of water damage.

One or more of the above-disclosed embodiments, in addition to certain alternatives, are provided in further detail below with reference to the attached figures. The disclosed subject matter is not, however, limited to any particular embodiment disclosed.

Figure 1:
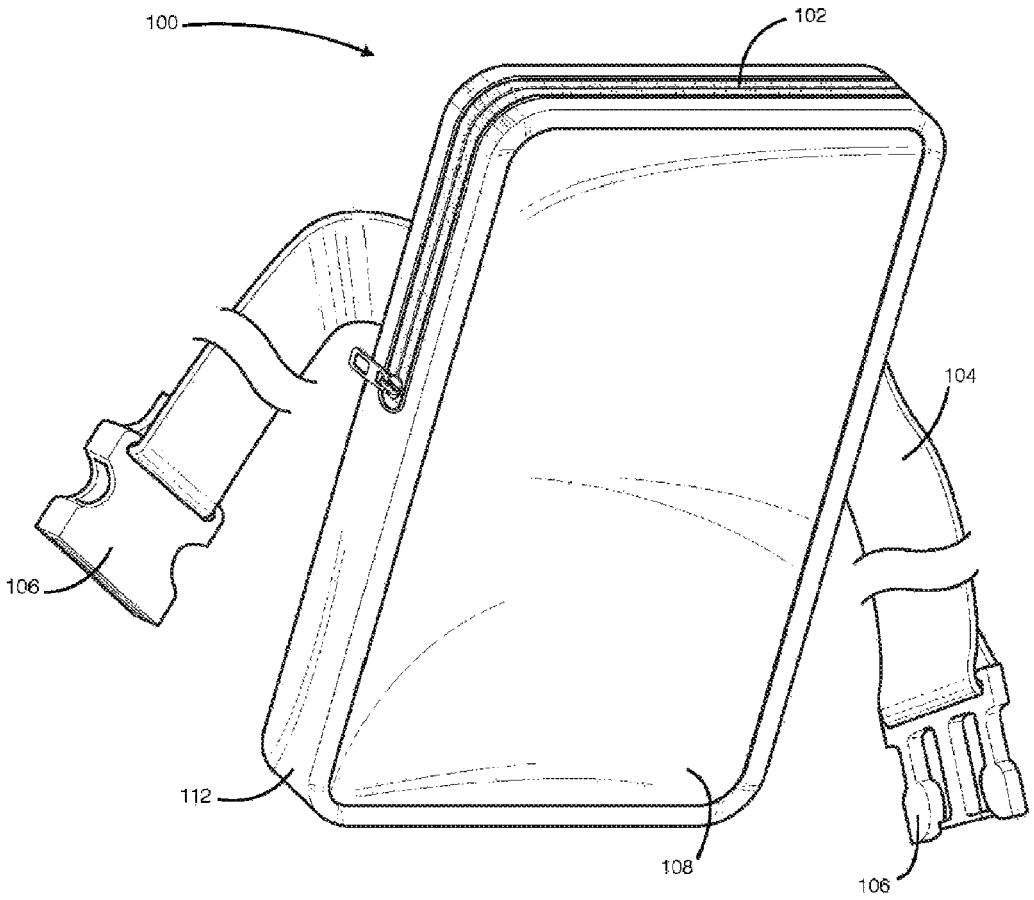
FIG. 1 is a front perspective view of the nested, water-resistant pack in accordance with one embodiment.

The disclosed embodiments may be better understood by referring to the figures in the attached drawings, as provided below. The attached figures are provided as non-limiting examples for providing an enabling description of the apparatus claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
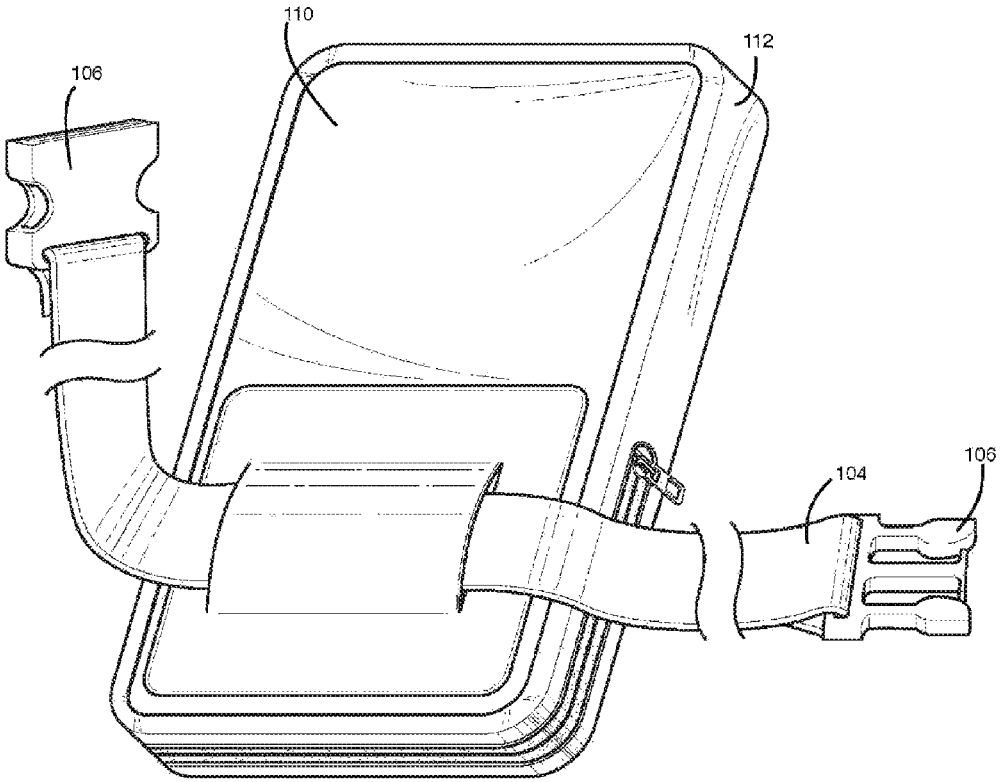
FIG. 2 is a rear perspective view of the nested, water-resistant pack in accordance with one embodiment.

With reference to FIGS. 1 and 2 an embodiment of the nested pack may comprise an outer container 100 defining a cavity sized to receive one or more items, such as, for example various personal effects. Such effects may include, but of course should not be limited to, any mobile electronic devices, such as tablet computers, smartphones, cellular phones, cameras, flashlights, and watches; lighters; matches; wallets; pocket and checkbooks; passports; identification cards; money; tissues; medication; and any other items a person may deem desirable to carry on his person. The cavity may be accessible via a resealable opening 102 disposed on a portion of the outer container 100.

A strap may be disposed on the outer container 100 to enable hands-free transportation of the pack. In some embodiments, the strap 104 may comprise a means for securely fastening the pack to the body of a wearer, for example, around a wearer's waist. For example, one such means for fastening the pack may be a side-release, also known as pinch, buckle 106 such as illustrated in FIGS. 1 and 2. As another example the means for fastening may be another type of buckle, or even a snap, clasp, slide fastener, hook and loop fastener, or any other type of fastener. It is also contemplated, however, that the strap may be alternatively disposed on the outer container 100 in a position that enables wearing the pack as a cross-body bag, know to those skilled in the art. In such embodiments, means for fastening the strap may or may not be included. Additionally, it should be noted that the strap may be adjustable and even elastic to achieve longer or shorter lengths to accommodate wearers of various sizes.

It is contemplated that the outer container 100 may be more particularly defined by a front side 108 and a back side 110, spaced apart by a side panel 112 which may comprise a single piece of material or multiple pieces of material. It may be seen that the resealable opening 102 may be disposed on such side panels 112.

Figure 3:
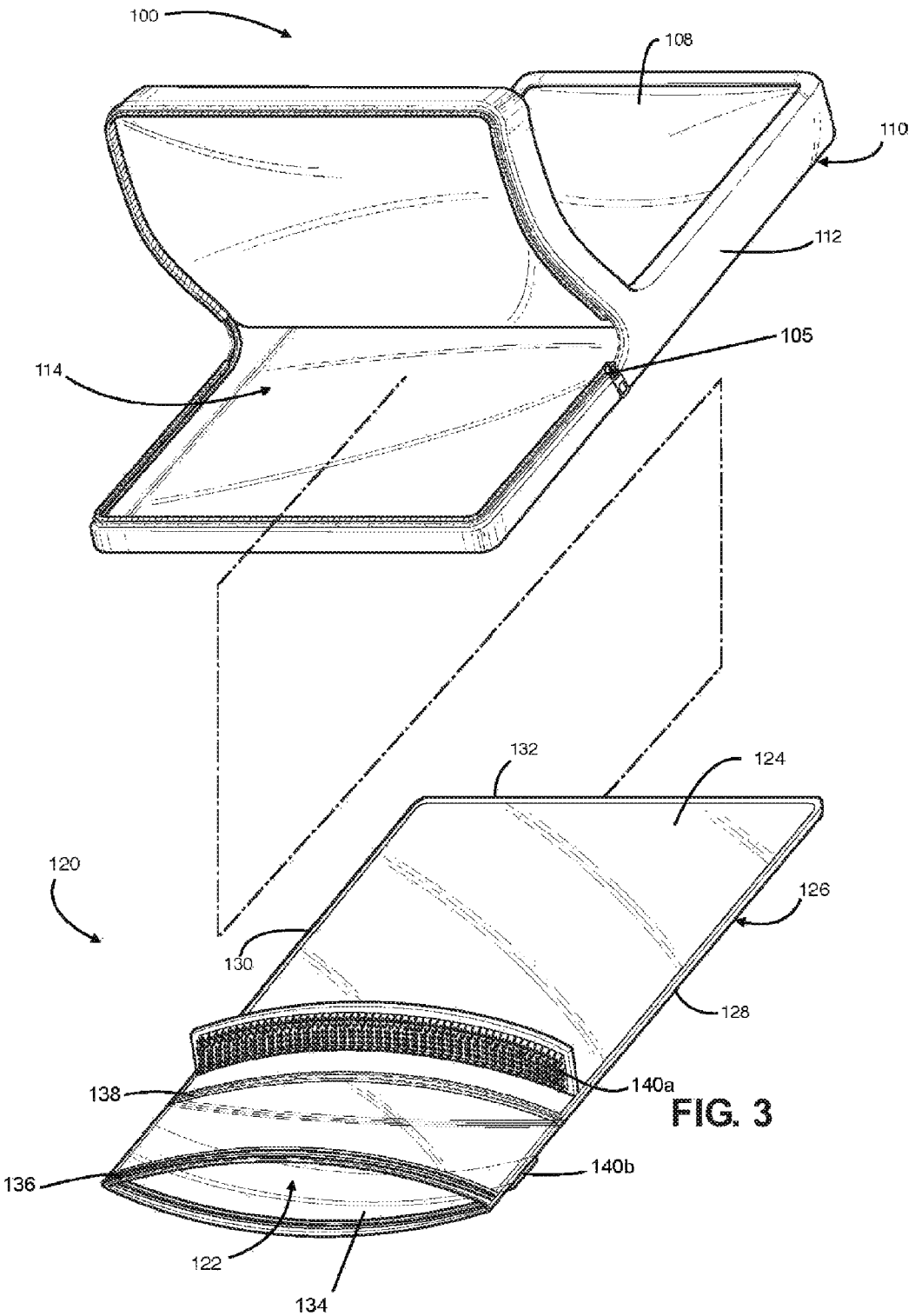
FIG. 3 is an exploded view of the nested, water-resistant pack in accordance with one embodiment.

As shown in FIG. 3, the outer container 100 may comprise a flexible, rugged material capable of withstanding repeated use and exposure to the elements, including water. Indeed, portions of the outer container 100 may be bent or folded to permit access to the cavity 114 sized to wholly receive any of a wearer's various personal effects. In some embodiments, then, the outer container 100 comprises any or a combination of polyurethane knit fabric, polyurethane laminate fabric, nylon, and vinyl, among others known in the art. In other embodiments, naturally absorbent materials, such as cotton, canvas, linen, and leather, among others, may additionally be coated or laminated with various waterproofing materials known in the art to comprise the water-resistant outer container 100. For example, and without limitation, such coatings and laminates may comprise any of natural or synthetic rubber, polyurethane, fluoropolymers, and wax.

Other water-proofing elements are contemplated. For instance, water-resistant adhesive may be used to secure portions of the side panel 112 to the front side 108 and a back side 110 of the outer container 100. In the event that any portions of the outer container 100 are torn or punctured, which may occur if any part of the front side 108, back side 110, side panel 112 are stitched together, seals such as those comprised of silicone may be applied to prevent moisture from entering therethrough. Indeed, any part of the outer container 100 may be reinforced with additional means for sealing.

It is contemplated that such flexible yet water-resistant materials may avoid adding uncomfortable bulk and weight that is often associated with waterproof carriers. Additionally, in some embodiments, forming the outer container 100 as a generally rectangular prism may enhance comfort by first accommodating the typical shape of many mobile electronic devices. Indeed, the pack may be oriented to be worn as an external pocket, so that it comfortably rests below the wearer's hip joint and in front of his thigh. One skilled in the art, however, will recognize that the shape and orientation of the bag in no way limit the invention.

In some embodiments, the one or more side panels 112 may overlap with a portion of the front side 108 and back side 110, as illustrated in FIGS. 1-3 and further adhered to one another to with a waterproof adhesive and/or sealant to reinforce portions of the outer container 100 against potential seepage in the event that the outer container 100 comes into contact with moisture or even becomes submerged in a liquid. However, it is also contemplated that the outer container 100 may be formed as a single piece.

As additional insurance against seepage into the outer container 100, means for resealing the opening 102 may be disposed on a portion of the outer container 100. For example, means for resealing the opening 102 may be disposed on an upward-facing portion of the side panel 112. This may ease a wearer's access to any contents within the container 100. In one embodiment in particular, the means for resealing the opening 102 may comprise any water-resistant zipper 105 known to those skilled in the art. In other embodiments, the means for resealing the opening 102 may comprise hook and loop fasteners or even adhesive that remains tacky over multiple uses.

Next, and with reference to FIG. 3, a pouch 120 is disposable within the cavity 114 defined by the outer container 100. The pouch 120 similarly defines a cavity 122 for receiving personal effects and, more particularly, may be sized to receive one or more personal electronic devices.

In one embodiment, pouch 120 comprise a first layer 124 and a second layer 126 permanently bonded to one another along a respective first edge 128, second edge 130, and bottom edge 132. Respective, unbonded top edges 134 may define an opening to the cavity 122 to receive personal effects for moisture-protected storage between the first and second layers 124, 126. Indeed, it is contemplated that the first and second layers 124, 126 comprise water-impermeable materials which are also resistant to tearing. For example, the first and second layers 124, 126 may comprise, for example, multi-laminate polyurethane materials, polyvinyl chloride (PVC), among others known in the art.

Means for sealing the pouch 120 may then be disposed along the top edges 134 of the pouch 120. Indeed, in some embodiments, multiple means for sealing the pouch are provided to ensure that any openings in the pouch 120 may be redundantly secured against seepage that might occur in the event that the pouch 120 is exposed to any moisture. In one embodiment, at least one of the means for sealing the pouch 120 may comprise a securely mateable press-to-seal type zippers known in the art. For instance, in FIG. 3, it may be seen that respective, mateable portions of a first press-to-seal zipper 136 and a second press-to-seal zipper 138 are sequentially placed facing and away from one another in line with the top edges 134 of the first and second layers 124, 126. A user of the pack may cause such press-to-seal zippers 136, 138 to become securely mated by forcibly pressing such seals to prevent water from entering the cavity 122 defined by the pouch 120.

It is contemplated that providing redundant and successive means for sealing the pouch 120 in this manner may ensure that any incidental moisture poised to enter the cavity 122 on account of an imperfectly secured first seal, may be further prevented from contacting any personal items stowed within the cavity 122 by the second seal. One skilled in the art will recognize that the invention may be practiced with only one means for sealing the pouch, or even two or more successive means for sealing the pouch 120. Additionally, such means are provided as press-to-seal zippers by way of example only and not of limitation.

To even further prevent ingress of moisture, it is contemplated that the pouch may be foldable from the top ends 134 and then secured by additional means to obscure the opening between the top ends 134 by physically shielding such opening, though sealed, from direct contact with water. For example, opposing hook and loop fasteners 140*a*, 140*b* may be provided and variously positioned on portions of the first and second layers 124, 126. When the pouch 120 is folded from the top ends 134 over any successive means for sealing the pouch, such as the press-to-seal zippers 136, 138 shown in the drawings, then opposing hook and loop fasteners 140*a*, 140*b* may be meshed to secure any folded portion of the pouch in place. Of course, it will be understood that alternative means for securing any folded portion of the pouch may be provided. For example and without limitation, one or more snaps, clips, buttons, or other means for securement may be provided instead of or in addition to the hook and loop fasteners.

Figure 4A:
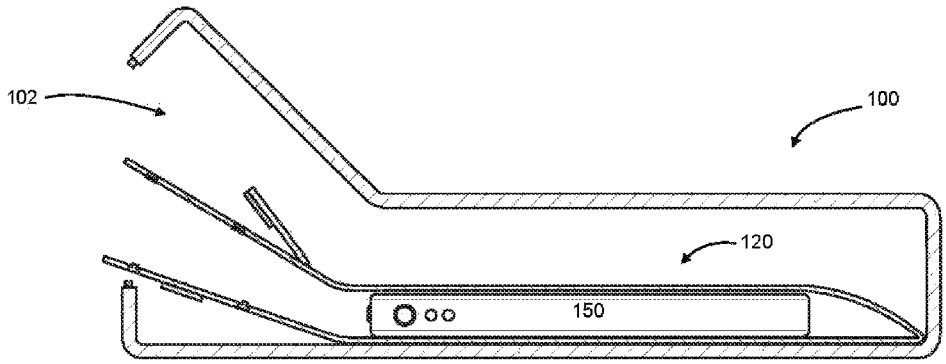
FIG. 4A-C show successive, cross sectional views of the nested, water-resistant pack in accordance with one embodiment.
Figure 4B:
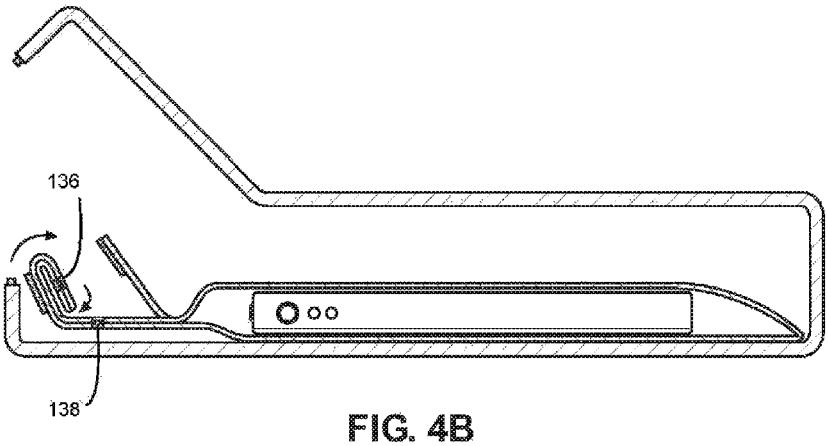
Figure 4C:
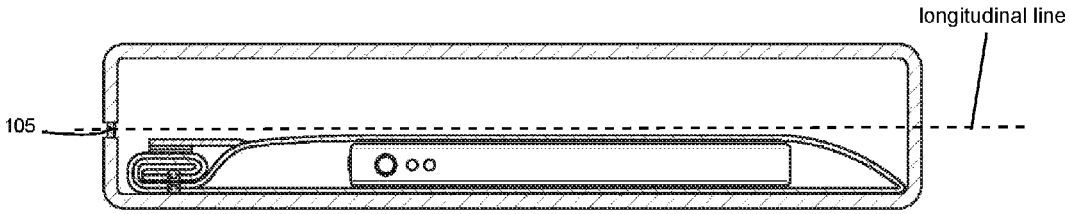

Referring now to FIGS. 4A through 4C, successive cross-sectional views are provided to illustrate one embodiment of the nested pack in operation. First, with reference in particular to FIG. 4A, it may be seen that the pouch 120 may be disposed within the cavity 102 defined by the outer container 100. Next, one or more moisture-sensitive personal items, such as a smartphone 150 shown in the figures, may be placed within the cavity 122 defined by the pouch 120. It will be noted that additional items may be placed within the outer container 100 as well, and, owing to the outer container's 100 contemplated water-resistance, will be protected from damage as well.

Next, as demonstrated FIG. 4B, any opening in the pouch 120 may be sealed by forcibly mating a first press-to-seal zipper 136 and a second press-to-seal zipper 138 sequentially placed on the pouch 120. Of course, other means for sealing the pouch are also contemplated. Then, to further prevent contact with any moisture, the pouch 120 may be folded over such means for sealing.

Finally, as in FIG. 4C, means for securing a folded portion of the pouch 120 may be engaged to obscure possible opening in the pouch 120 from incidental or direct contact with moisture. Here, such means are opposing hook and loop fasteners 140*a*, 140*b*, which have been engaged via meshing, however, it is to be understood that other means for securing a folded portion of the pouch 120 in a folded position is contemplated. Additionally, means for sealing the outer container 100 may be engaged to prevent moisture from entering the outer container 100 at all so that any belongings maintained in either the outer container 100 or pouch 120 remain dry. Indeed, it may be seen that not only is the opening obscured by multiple folds in the pouch 120, but also, the pouch may be closely maintained in its folded position to prevent moisture from flowing or travelling near the opening at all.

Returning to FIG. 3, placement of the means for securing any folded portion of the pouch may be placed in many different positions. For example, it should be noted that one of the opposing portion of the hook and loop fastener 140*a* is shown disposed along a flap extending from the first layer 124 of the pouch 120, and the other portion of the hook and loop fastener 140*b* is shown disposed along the second layer 126 of the pouch 120. However, it is also contemplated that alternative placement of the means for securing the folded portion of the pouch 120 may also obscured any openings in the pouch from moisture. For instance, portion 140*a* of the hook and loop fastener, or any other means for securement, may be disposed on the surface of the first layer 124 rather than extend from it. Thus, the orientation provided is offered by way of example only and not of limitation.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, particular dimensions of either the water resistant case or the waterproof pouch may vary according to the needs of the user. Additionally, the case and the pouch may each take various geometric shapes without departing from the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the nested, water-resistant pack with which that terminology is associated. In general, the terms used in the following claims should not be constructed to limit the nested, water-resistant pack to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the nested, water-resistant pack is not intended to be exhaustive or limited to the precise form disclosed above or to a particular field of usage.

While specific embodiments of, and examples for, the apparatus are described above for illustrative purposes, various equivalent modifications are possible for which those skilled in the relevant art will recognize.

While certain aspects of the apparatus are presented below in particular claim forms, various aspects of the apparatus are contemplated in any number of claim forms. Thus, the inventor reserves the right to add additional claims after filing the application to pursue such additional claim forms for other aspects of the nested, water-resistant pack.

What is claimed is:

1. A pack, comprising:

a water resistant outer container defining a first cavity accessible through a first opening located along an upper portion of the outer container, the upper portion of the outer container comprising a water resistant seal; and a waterproof inner container located within the first cavity, the inner container defining a second cavity accessible through a second opening located along an upper portion of the inner container, the upper portion of the inner container comprising a hook and loop fastener, a first press-to-seal zipper, and a second press-to-seal zipper, the inner container comprising a waterproof seal located along the upper portion of the inner container, the waterproof seal including a first folded over portion and a second folded over portion such that the waterproof seal defines a folded position and an unfolded position, wherein at least a portion of the hook and loop fastener is located between the first press-to-seal zipper and the second press-to-seal zipper when the waterproof seal is in the unfolded position.

2. The pack of claim 1, wherein the water resistant seal comprises a zipper.

3. The pack of claim 1, wherein the hook and loop fastener is located between the first folded over portion and the second folded over portion when the waterproof seal is in the folded position.

4. The pack of claim 1, wherein a longitudinal line crosses through the water resistant seal which divides the first cavity into a top half and a bottom half, and wherein when the waterproof seal is in the folded position the first press-to-seal zipper, the second press-to-seal zipper, the hook and loop fastener, and the waterproof seal are all located along the bottom half of the cavity.

5. The pack of claim 1, wherein a longitudinal line crosses through the water resistant seal which divides the first cavity into a top half and a bottom half, and wherein a majority of the inner container is located along the bottom half.

6. The pack of claim 5, wherein the entire inner container is located along the bottom half.

7. The pack of claim 1, further comprising a strap disposed along an outer surface of the water resistant outer container, wherein the outer container defines a cuboid shape.

8. The pack of claim 1, wherein at least a portion of the hook and loop fastener is located along a lower portion of the inner container when the inner container is in the unfolded position.

9. The pack of claim 1, wherein at least a portion of the inner container extends out of the outer container when the inner container is in the unfolded position.

10. The pack of claim 1, wherein at least a first portion of the hook and loop fastener faces away from a first portion of the first press-to-seal zipper and a first portion of the second press-to-seal zipper.

11. The pack of claim 10, wherein at least a second portion of the hook and loop fastener faces towards a second portion of the first press-to-seal zipper and a second portion of the second press-to-seal zipper.

12. A pack, comprising:

a water resistant outer container defining a first cavity accessible through a first opening located along an upper portion of the outer container, the upper portion of the outer container comprising a water resistant seal; and a waterproof inner container located within the first cavity, the inner container defining a second cavity accessible through a second opening located along an upper portion of the inner container, the upper portion of the inner container comprising a hook and loop fastener, a first press-to-seal zipper, and a second press-to-seal zipper, the inner container comprising a waterproof seal located along the upper portion of the inner container, the waterproof seal including a first folded over portion and a second folded over portion such that the waterproof seal defines a folded position and an unfolded position, wherein the hook and loop fastener is located between the first folded over portion and the second folded over portion in a direction from the second opening to the second cavity when the waterproof seal is in the folded position.

13. The pack of claim 12, further comprising a flap that extends from an upper portion of the inner container.

14. The pack of claim 13, wherein at least a portion of the hook and loop fastener is located on the flap.

15. The pack of claim 12, wherein a longitudinal line crosses through the water resistant seal which divides the first cavity into a top half and a bottom half, and wherein when the waterproof seal is in the folded position the first press-to-seal zipper, the second press-to-seal zipper, the hook and loop fastener, and the waterproof seal are all located along the bottom half of the cavity.

16. The pack of claim 12, wherein a longitudinal line crosses through the water resistant seal which divides the first cavity into a top half and a bottom half, and wherein a majority of the inner container is located along the bottom half.

17. The pack of claim 12, wherein the waterproof seal is entirely located within the outer container when the waterproof seal is in the folded position.

18. A pack, comprising:

a water resistant outer container defining a first cavity accessible through a first opening located along an upper portion of the outer container, the upper portion of the outer container comprising a water resistant seal; and a waterproof inner container located within the first cavity, the inner container defining a second cavity accessible through a second opening located along an upper portion of the inner container, the upper portion of the inner container comprising a hook and loop fastener, a first press-to-seal zipper, and a second press-to-seal zipper, the inner container comprising a waterproof seal located along the upper portion of the inner container, the waterproof seal including a first folded over portion and a second folded over portion such that the waterproof seal defines a folded position and an unfolded position, wherein both the first press-to-seal zipper and the second press-to-seal zipper are located between the first folded over portion and the second folded over portion when the waterproof seal is in the folded position.

19. The pack of claim 18, wherein the first press-to-seal zipper and the second press-to-seal zipper are substantially aligned when the waterproof seal is in the folded position.

20. The pack of claim 18, wherein both the first press-to-seal zipper and the second press-to-seal zipper are located under the hook and loop fastener when the waterproof seal is in the folded position.

* * * * *